US010272479B2

(12) United States Patent
Pickett

(10) Patent No.: US 10,272,479 B2
(45) Date of Patent: Apr. 30, 2019

(54) METHOD AND APPARATUS FOR CLEANING AND STERILIZING PRODUCT LINES

(76) Inventor: Joseph S. Pickett, Henderson, NV (US)

( * ) Notice: Subject to any disclaimer, the term of this patent is extended or adjusted under 35 U.S.C. 154(b) by 1031 days.

(21) Appl. No.: 13/818,472

(22) PCT Filed: Aug. 16, 2011

(86) PCT No.: PCT/US2011/047929

§ 371 (c)(1),
(2), (4) Date: Feb. 22, 2013

(87) PCT Pub. No.: WO2012/027158

PCT Pub. Date: Mar. 1, 2012

(65) Prior Publication Data

US 2013/0146096 A1 Jun. 13, 2013

Related U.S. Application Data

(60) Provisional application No. 61/377,233, filed on Aug. 26, 2010.

(51) Int. Cl.
*B08B 9/032* (2006.01)
*B67D 1/07* (2006.01)

(52) U.S. Cl.
CPC ..... *B08B 9/0321* (2013.01); *B08B 9/0328* (2013.01); *B67D 1/07* (2013.01)

(58) Field of Classification Search
CPC ..... B08B 9/0321; B08B 9/0328; B67D 1/07
See application file for complete search history.

(56) References Cited

U.S. PATENT DOCUMENTS

| | | | | |
|---|---|---|---|---|
| 3,734,850 | A | 5/1973 | Karr | |
| 4,572,230 | A | 2/1986 | Mirabile | |
| 5,167,126 | A | 12/1992 | Cartwright | |
| 5,699,817 | A | 12/1997 | Bankert et al. | |
| 2001/0047813 | A1 | 12/2001 | Labib et al. | |
| 2002/0189647 | A1 * | 12/2002 | Labib | A61C 1/0076 134/22.12 |
| 2004/0004007 | A1 * | 1/2004 | Orolin | A61L 2/035 205/701 |
| 2008/0216876 | A1 | 9/2008 | Lafon et al. | |
| 2009/0217951 | A1 | 9/2009 | Ngo et al. | |

FOREIGN PATENT DOCUMENTS

CA 2310738 A1 * 12/2000

* cited by examiner

*Primary Examiner* — Alexander Markoff
(74) *Attorney, Agent, or Firm* — Zarley Law Firm

(57) ABSTRACT

System and method for cleaning a product line of a fluid dispensing system. The cleaning system includes a first container that contains liquid and a second container that contains gas such that the cleaning system is attached to the product line of a liquid dispensing system so that cleaning fluid can be pumped through the line that has gas pockets therein. The gas pockets work to create sheer within the product line in order to clean biomass and other contaminates from within the product line.

18 Claims, 4 Drawing Sheets

METHOD AND APPARATUS FOR CLEANING AND STERILIZING PRODUCT LINES

CROSS REFERENCE TO RELATED APPLICATION

This application claims the benefit of U.S. Provisional Application No. 61/377,233 filed Aug. 26, 2010.

BACKGROUND OF THE INVENTION

This invention is directed toward a method and apparatus for beverage lines. More specifically, this invention is directed toward cleaning and sterilizing of beverage lines.

Cleaning retail beer, soda, wine, liquor, juice and condiment lines has been a necessary requirement for many years in order to maintain the taste and appearance of the beverages supplied through condiment lines. Specifically, as applied to beer and other associated beverage, line cleaning is required in order to ensure that the taste and appearance is of the same quality as brewery fresh beer. Numerous considerations are necessary to maintain draft beer quality standards, including but not limited to cooler management (such as proper temperature control, product rotation and the like) in addition to the quality and type of gas used to pressurize kegs and even the cleaning and proper serving techniques relating to the beer glass itself. However, even when all such conditions are perfect, proper maintenance and cleaning of the lines that deliver the beverage remains crucial, because improperly maintained beverage lines can single-handedly compromise the taste, appearance, and quality of the beverage, particularly due to the prevalence of "long line" technology over the past several years. As opposed to "under the bar" systems used in the past, the remote location of beer kegs has been increasing, as "long line" installations often utilize beverage lines which can be over 300 to 400 feet in length. Such installations have posed particular problems in terms of maintenance, sterilization, and cleaning, adversely impacting sales as draft beer for a retailer is a major profit center and sampling point for retailers, in addition condiments or food can pose health risks to consumers.

As compared to the surface to product ratio of a keg, the surface to product contact ratio in such long beverage lines is magnified thousands of times when a beverage such as beer is actively drawn to flow through the potentially hundreds of feet of beverage line from a remote keg to the point of dispensing, and the contact ratio is magnified even further when the beer is maintained stagnant in the line in between servings. Thus, the physical and biological cleanliness of these lines is critical to taste, physical appearance and foam quality of the product being served, as the accumulation of various substances which soil the lines alone can serve to destroy the quality of the product in an otherwise perfect beverage installation and dispensing system. Unfortunately, the substances present in such beverage lines have posed a particular problem in terms of sanitization, maintenance, sterilization and cleanliness due to the unique characteristics of the soiling substances produced by the beer and beverages flowing through such lines.

Biofilms, layers of microorganisms and other materials adhering to the surfaces of beverage lines constitute a serious problem in food and beverage lines. Microorganisms such as *lactobacillus brevis*, endobacter agglomerans, various species of the genus *acetobacter*, along with yeasts, molds, and other bacteria, hop resins, mineral crystals, protein, carbohydrates, silica gel, fibers, diatomaceous earth, sodium carbonate and other materials form biofilms and soils on the inner surfaces of lines which are deposited and accumulate over time as beer and other beverages flow through beverage lines, serving not only to adversely impact the quality, appearance and taste of the beverage, but also present health concerns for food products, leading to spoilage. Such substances formed on the line walls not only present beverage quality and health concerns, but also are particularly problematic with respect to accumulation and removal, making the cleaning and removal process virtually impossible in a reasonable fashion.

The foregoing substances in addition to biofilms formed by microbial cells, extra cellular polymers, and abiotic particles, once formed, can retard diffusion inside the biofilm, forming a barrier preventing penetration due to the use of cleaning solutions. The biomass and soils adhere to the walls of the line by mechanical and biological means; formation begins with the attachment of free-floating organisms to a surface of the beverage line. Unless the colonists are immediately separated from the surface, the arrival of other cells is facilitated by the provision of more diverse adhesion sites building a resistant matrix holding the biofilms together. The colonist also protects the cells contained therein and facilitates communication, additional breeding and growth. This forms a dense inter and extra cellular matrix with a boundary layer which is not only resistant to detergents, antibiotics and disinfectants but also can potentially become fossilized. Consequently, such conditions facilitate exponential growth, as the formed biofilms provide a breeding ground for explosive growth of the above organisms that cause undesired flavors, particulate matter, and poor foam quality in the beer.

Many methods and systems have been developed to clean and sterilize beverage lines, attempting to improve upon existing long line cleaning systems. Great effort has been made to develop an effective composition of a cleaning solution in order to remove soils more effectively. In addition, other cleaning and sterilization techniques have been developed such as mechanical methods and physical methods (such as sponges). These methods have been met with only moderate success due to in-line restrictions due to the dimensional characteristics of the long line beverage lines.

Other cleaning and sterilization systems have been developed which have utilized pumps to utilize turbulent flow as defined by Reynolds number. Turbulent flow usually occurs at high flow rates and/or in larger diameter pipes and is characterized by chaotic, irregularly mixing fluid with constant changes in the flow's behavior, including wakes, vortexes, and eddies, making flow rates impossible to accurately measure. Turbulent flow is usually desirable when solids must remain suspended in the fluid to prevent settling or blockages; however, Reynolds numbers and systems utilizing turbulent flow lose significance and are ineffective when dealing with smaller diameter beverage and beer lines. Such systems do not have the capacity to lift out solid soils nor remove soils adhering to the line walls.

Many recognized methods employ one or more of the aforementioned techniques with varying degrees of success, such as "pot cleaning," utilizing a static liquid cleaning compound which is then pushed, which is usually done with carbon dioxide, air or gas. However, pot cleaning produces an undesired effect; because carbon dioxide is an acid in water the carbon dioxide reacts with the basic cleaner to form sodium carbonate which joins the biomass as a mineral salt.

Sponge cleaning involves inserting a sponge in the beverage line which is subsequently pushed through the line with liquid. In addition to the aforementioned limitations, sponge cleaning is characterized by additional deficiencies as sponges often become stuck due to line restrictions and are unsanitary.

Additional methods and systems include "circulation cleaning" wherein cleaning liquid is circulated through the lines, and "ultrasonic cleaning" involving an ultrasonic device placed on the line to discourage biofilm adhesion. Still, no current system or method is available which effectively penetrates the critical boundary layer of the liquid flow in the line, to engage the interior boundary at which the majority of the soil adheres to the walls of the beverage lines by mechanical and biological means, particularly in beverage lines with smaller diameters. As a result, a need has arisen for a sterilizing and cleaning system for beer and beverage lines which improves upon and overcomes the problems associated with existing systems which is fast, versatile and effective on all beverage lines.

Therefore a primary object of this invention is to provide a method and apparatus for cleaning and sterilizing beverage lines that improves cleaning performance.

It is yet another object of this invention to provide a method and apparatus for cleaning and sterilizing beverage lines that requires less cleaning solution, less chemical volume, and less chemical strength.

A further object of this invention is to provide a method and apparatus for cleaning and sterilizing beverage lines that provides a greater degree of mechanical cleaning action.

These and other objects, features or advantages of the present invention will become apparent from the specification and claims.

BRIEF SUMMARY OF THE INVENTION

A method of cleaning a product line of a fluid dispensing system. The method includes steps of providing a dispensing system having a product line extending from a first end to a second end that fluidly connects at least one container to a dispensing station. The product line is detached from the container and the dispensing station and a cleaning system is provided that has a first container that contains liquid and a second container that contains gas that is connected to the first end of the product line. Liquid and gas is then injected into the product line in order to form a plurality of gas pockets within the liquid being injected in order to clean the product line.

DETAILED DESCRIPTION OF THE PREFERRED EMBODIMENT

Figure 1:
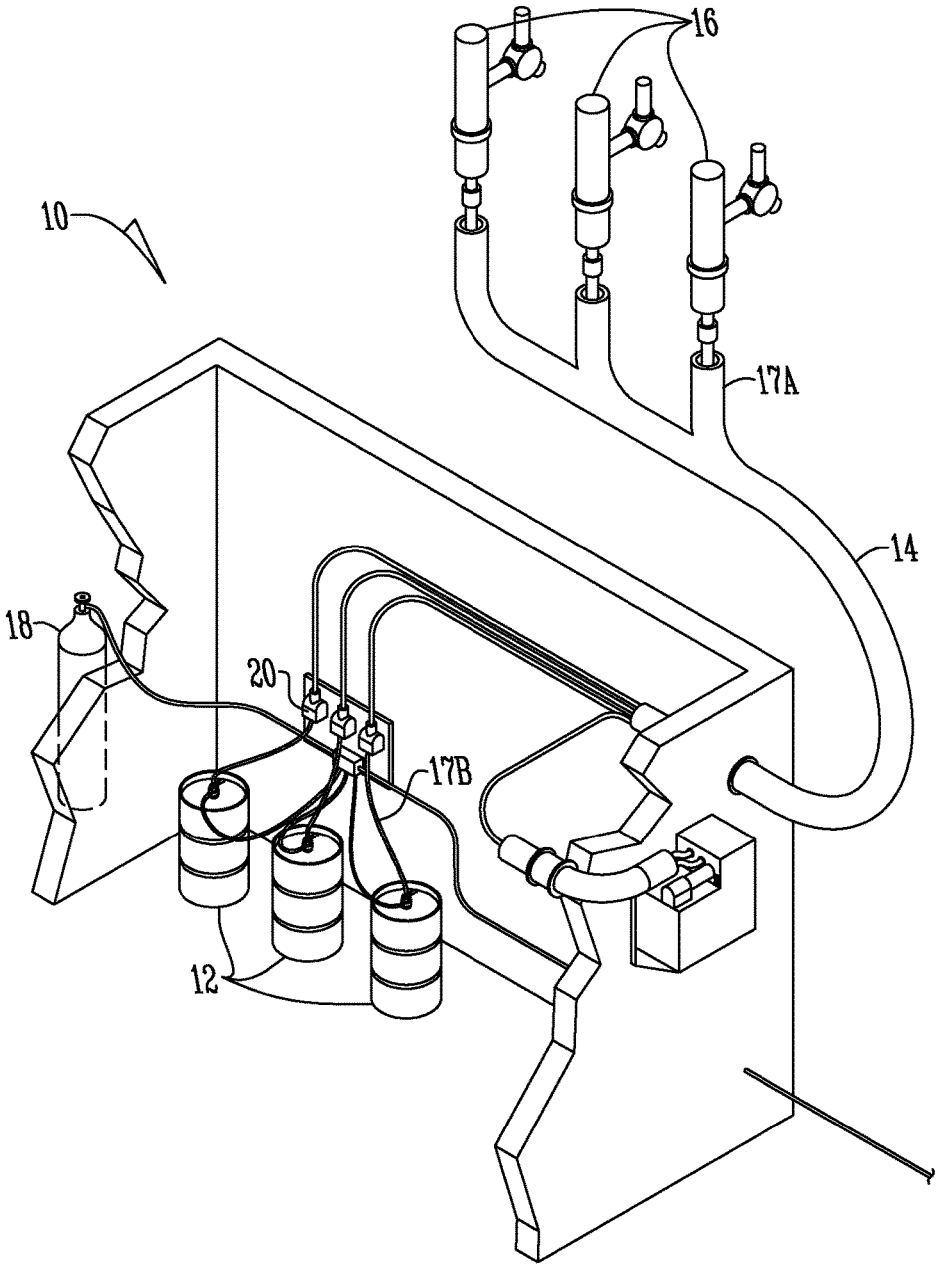
FIG. 1 is a perspective view of a product storage and dispensing installation system.
Figure 2:
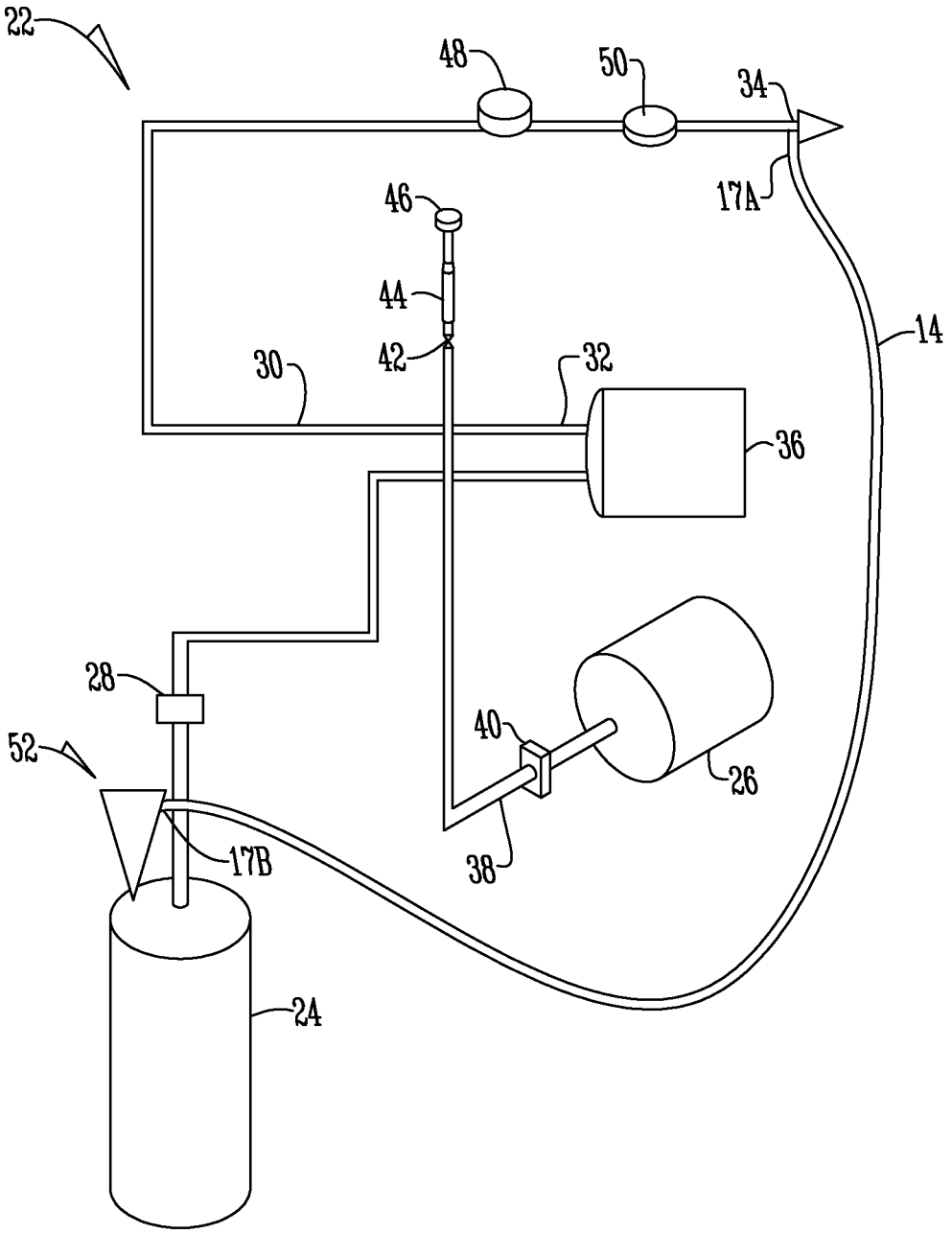
FIG. 2 is a perspective view of a cleaning system.
Figure 3:
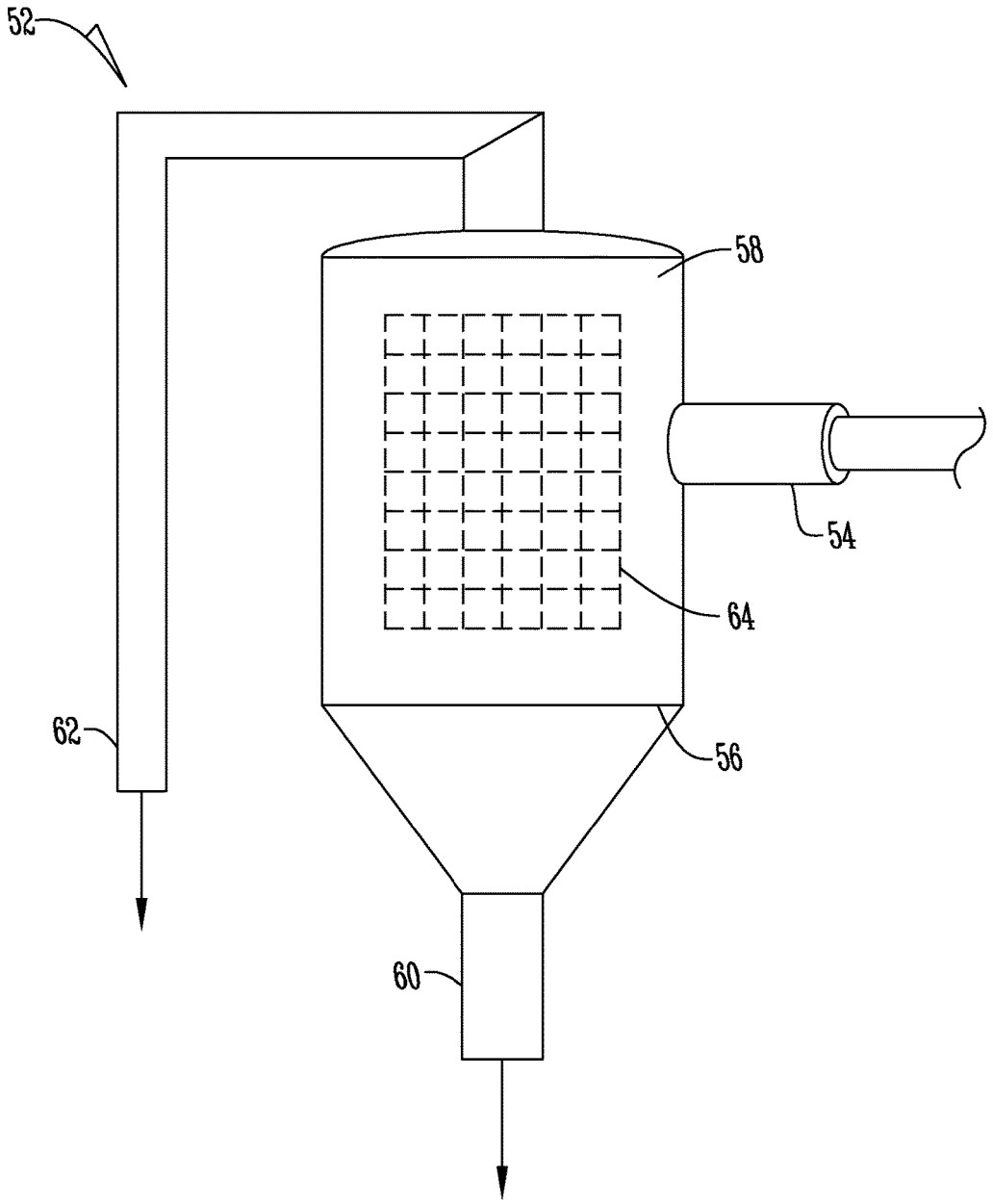
FIG. 3 is a perspective view of the separator of a cleaning system.
Figure 4:
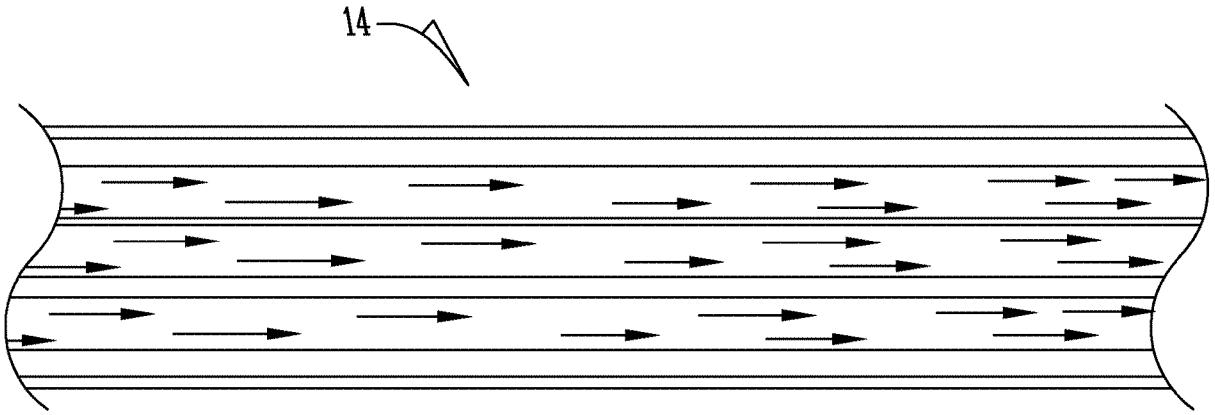
FIG. 4 is a side cross sectional view of a product line and schematic view of conventional laminar flow and the boundary layer.
Figure 5:
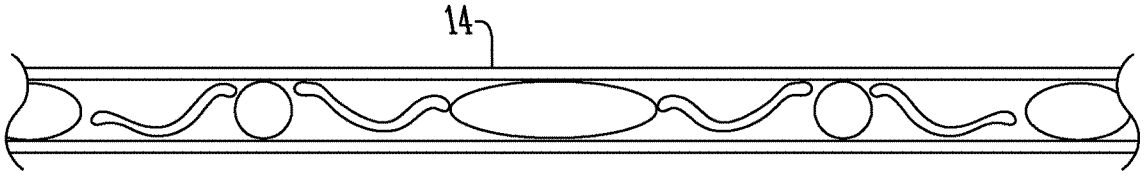
FIG. 5 is a side cross sectional view of a product line and schematic view of the liquid flow according to the present method and apparatus for cleaning and sterilizing product lines.

Referring to the figures, a method and apparatus for cleaning and sterilizing lines of a product storage and dispensing installation is provided as shown in system 10. In one embodiment the system 10 comprises one or more containers 12, with one or more container lines 14 or product line 14 which supply fluid to one or more dispensing stations 16. The product line 14 extends from a first end 17A to a second end 17B. In a preferred embodiment the containers 12 are kegs. The fluid can be any beverage such as beer, soda, wine, liquor, or juice. However, the scope of the present invention is not limited to retail beverage distribution lines, as the present invention is equally applicable with respect to distribution lines carrying substances capable of depositing biofilms and/or soils on the interior walls distribution lines including but not limited to condiments, dairy products, ingredients used in the preparation or manufacture of foods, or chemicals.

The product line 14 is supplied with gas (such as CO2) from a gas container 18 to carbonate the product in embodiments wherein the product is a beverage served carbonated such as beer. In addition, or alternatively, the product line 14 is connected to a pressure source 20 or pump which pressurizes or pumps, respectively, the product filled lines 14 to facilitate the flow of the product from the one or more containers 12 through the one or more lines 14 to the one or more dispensing stations 16.

The system 10 also includes a cleaning system 22 having a first container 24 that is a liquid source, a second container 26 that is a gas source, and a pump 28 that connects to the product line 14 of the system 10. The first container 24 contains liquid which in a preferred embodiment is cleaning solution. A liquid supply line 30 is connected to and originates from the first container 24 at a first end 32 and at a second end 34 is attached in fluid communication to a first end 17A of the product line 14 of the system 10 such that the liquid of the first source container 24 flows from the source container, through the liquid supply line 30 and into and through the product line 14. The liquid supply line 30 includes a pump 36 to draw the liquid from the first container 24 such that the liquid flows into the liquid supply line 30 into and through the product line 14. In a preferred embodiment, the pump 36 pumps the liquid through the liquid supply line 30 and into the product line 14 at a constant flow rate into the product line 14.

The cleaning system 22 also includes the second container 26 that has a gas source and contains gas. In a preferred embodiment, the gas is an inert gas or insoluble gas such as air, nitrogen, or the like. The gas source provides gas through a gas conduit 38 which supplies inert gas to the liquid supply line 30 such that gas pockets are introduced and incorporated into the liquid flowing through the liquid supply line 30 and subsequently into the product line 14. In one embodiment, the second container 26 includes a nozzle 40 such as critical flow nozzle, or alternatively, includes a venturi nozzle. In yet another embodiment, the second container 26 is an air compressor.

A flow control 42, flow meter 44, and check valve 46 are connected to the fluid supply line 30, gas conduit 38, second container 26, and pump 36. The flow control 42 actuates and regulates the amount and frequency by which gas is introduced into the liquid supply line 30 and incorporated into the liquid flowing through the supply line 30 and into the product line 14 in addition to regulating the rate at which the pump 36 pumps the liquid and gas into the product line 14. In conjunction with the flow meter 44, the flow control 42 allows the liquid and gas introduced into the product line 14 to be monitored and adjusted such that the optimum flow of liquid and gas is introduced into the supply line 30 and product line 14. Furthermore, the check valve 46 prevents the liquid from entering the gas conduit 38 when the flow of either the gas or liquid is stopped. The supply line 30 also includes a pressure gauge 48 and a sight glass 50 to monitor and observe, respectively, as the liquid and gas is pumped through the product line 14.

The cleaning system 22 additionally includes a separator 52 including a flow inlet 54, a body 56 having a hollow chamber 58, a liquid outlet 60, and a gas outlet 62. The flow inlet 54 is connected to a second end 17B of the product line 14 such that the fluid, gas, and any biofilm and/or soil particulate matter enters the hollow chamber 58 within the body 56 of the separator 52. Included within the hollow chamber 58 of the body 56 of the separator 52 is a filter 64 which receives the fluid, gas, and the biofilm and/or soil particulate matter exiting from the product line 14, separating the gas from the liquid such that the liquid flows downward and out of the bottom end of the separator 52 through the liquid outlet 60. The liquid outlet 60 empties into the first container 24 and the separated gas exits the hollow chamber 58 through the gas outlet 62, retaining any biofilm and/or soil particulate matter within the filter 64. In one embodiment, the filter 64 is steel wool. Alternatively, the filter 64 is any suitable material capable of separating fluid from gas while retaining particulate matter.

In operation, any existing components from a product storage and dispensing installation are disconnected or separated from the product line 14 such that the first and second ends 17A and 17B of the product line 14 are free. The first end 17A of the product line 14 is connected to the second end 34 of the liquid supply line 30 and the second end 17B of the product line 14 is connected to the flow inlet 54 of the separator 52 of the clean system 22. The pump 36 begins pumping liquid into the liquid supply line 30 from the first source container 24. As a result of the suction created by the fluid flowing through the liquid supply line gas is pulled or flows from the nozzle 40 of the gas source of the second container 26, through the gas conduit 38 to introduce gas into the liquid flowing in the liquid supply line 30. Thus, a controlled flow of inert gas is provided within the liquid to produce a plurality of inert gas bubbles or gas pockets separating adjacent pockets of liquid which overcomes the deficiencies with existing cleaning and sterilization systems associated with laminar flow as provided below. Thus, the bubble, or gas pocket, eliminates the liquid boundary layer and subsequently creates tremendous wall shear.

A beverage line is shown wherein a layer of biofilm and soils have been deposited on the interior wall of the beverage line 14. As typical with fluid flow in beverage lines 14 of small diameters (for example, diameters of one-half inch or less), fluid such as a cleaning solution and/or water introduced into such beverage lines 14 is characterized by a laminar flow, consisting of a series of outermost, intermediate, and interior cylindrical flow boundaries wherein the fluid particles within each respective cylindrical flow boundary flow in a linear, axial direction with respect to the center axis of the line at different rates.

At the outermost cylindrical flow boundary adjacent to the layer of biofilm and soils deposited on the interior wall of the pipe, the friction between the layer of biofilm and soil deposited on the wall of the line and the fluid particles of the outermost cylindrical flow boundary is greater than that between the adjacent, liquid-to-liquid layers of the intermediate and interior cylindrical flow boundaries. Due to such friction in addition to viscosity, the fluid particles of the outermost flow boundary are the most resistant to flow, and do not move, or, alternatively, move at a rate slower than the particles of the intermediate and interior cylindrical flow boundaries.

The fluid particles of the intermediate cylindrical flow boundary move at an intermediate rate, faster than those of the outermost flow boundary but slower than those of the interior flow boundary due to the interface between the fluid particles of the outermost flow boundary and those of the intermediate flow boundary due to the pull exerted upon the particles of the intermediate flow boundary by the slowest, or stationary outermost boundary. Finally, the fluid particles of the interior cylindrical flow boundary move at the fastest rate relative to the outermost and intermediate boundaries, as the particles of the interior boundary are adjacent the intermediate boundary, comprising a liquid to liquid boundary interface wherein the interior boundary is separated from and unimpeded by the slowest innermost boundary by the intermediate boundary.

Unlike existing methods, in the present invention as the liquid begins to flow into the liquid supply line 30, the flow control 42 in addition to the flow meter 44 actuate and monitor the operation of the gas nozzle and gas source such that discrete bubbles, or gas pockets, of inert gas are created in the liquid. This separates the liquid into separate, adjacent pockets and at the same time controls the operation of the pump 36 such that rate of flow of liquid is optimized as the liquid flows into the product line 14, creating pulsating pockets of water and gas. By controlling the liquid and gas flow to introduce bubbles comprising pockets of inert gas which form and separate pockets of liquid, the gas bubbles push the liquid cleaning solution such that the cleaning solution alternately engages opposite interior walls of the product line 14 at a uniform rate as the liquid is pumped through the product line to thereby eliminate the slow, or alternatively stationary innermost boundary layer of liquid. In so doing, the controlled and measured gas pockets create bubbles of gas within the liquid which not only collapse and reform at choke points within the interior of the product line but also provide a mechanical action as the gas bubbles force the liquid to alternately engage the interior walls of the product line, causing turbulence, impingement and increasing mechanical shear by a measure of 80 to 100 fold in comparison to conventional methods.

Therefore the method incorporates mechanical scrubbing, scouring flow and the mechanical action of the cleaning solution liquid such that the cleaning solution liquid penetrates the outer boundary of the biofilm and soils deposited on the interior walls of the product line to completely access and remove the biofilm at the interior point of attachment at the line wall while at the same time sterilizing the beverage line. Furthermore, the pulsating pockets of water and gas are circulated multiple times through the product line to empty and fill the line, enhancing the washing action, forming water pockets which carry away the soil, eliminating foam which in long lines of small diameter limits the liquid flow, reducing the cleaning cycle frequency and reducing the volume and strength of chemical cleaning solution liquid required to clean and sterilize the beverage line. Thus, small bubbles or foam will not eliminate the liquid boundary layer; therefore there will not be any wall shear. Only the large bubble will completely empty the line for an instant. This will create the wall shear necessary to clean the line. Wall shear is the force applied by the solution that is perpendicular to the line wall. As a result at the very least all of the stated objectives have been met.

It will be appreciated by those skilled in the art that other various modifications could be made to the device without the parting from the spirit and scope of this invention. All such modifications and changes fall within the scope of the claims and are intended to be covered thereby.

What is claimed is:

1. A method of cleaning a product line of a fluid dispensing system steps comprising:

providing a dispensing system having a product line extending from a first end to a second end that fluidly connects at least one container to a dispensing station;

detaching the product line from the at least one container and the dispensing station;

providing a cleaning system having a first container containing a liquid and a second container containing a gas;

providing a liquid supply line that connects with the first end of the product line to provide a fluid connection between the first and second containers and the product line;

pumping the liquid through the liquid supply line which pulls the gas from the second container into a flow of the liquid within the liquid supply line such that a plurality of pulsating gas pockets form in the liquid; and cleaning the product line with the liquid having the plurality of pulsating gas pockets.

2. The method of claim 1 further comprising the steps of dispensing the liquid with the plurality of pulsating gas pockets into a separator through the second end of the product line; and filtering the liquid having the plurality of pulsating gas pockets at the separator to send the liquid through a fluid outlet to the first container.

3. The method of claim 2 further comprising the step of conveying the gas of the liquid having the plurality of pulsating gas pockets through a gas outlet of the separator.

4. The method of claim 1 wherein the gas is an inert gas.

5. The method of claim 1 wherein the liquid supply line has a sight valve disposed therein.

6. The method of claim 1 wherein a pump is connected to the liquid supply line for injecting the liquid into the product line.

7. The method of claim 6 wherein the pump pumps the liquid at a constant flow rate into the product line.

8. The method of claim 2 wherein the separator has a filter disposed therein that filters the liquid.

9. The method of claim 8 wherein the filter is formed of steel wool.

10. The method of claim 1 wherein the liquid is cleaning solution.

11. The method of claim 1 wherein the gas from the second container is pulled into the product line by suction created by the liquid moving in the product line.

12. The method of claim 1 wherein the plurality of gas pockets separate the liquid such that a plurality of liquid pockets form.

13. A method of cleaning a product line of a fluid dispensing system steps comprising:

providing a dispensing system having a product line extending from a first end to a second end that fluidly connects at least one container to a dispensing station;

detaching the product line from the at least one container and the dispensing station;

providing a cleaning system having a first container containing a liquid and a second container containing a gas;

providing a liquid supply line that connects with the first end of the product line to provide a fluid connection between the first and second containers and the product line;

pumping the liquid through the liquid supply line and introducing the gas from the second container into the liquid within the liquid supply line such that a plurality of pulsating pockets of liquid and gas form;

applying wall shear to the product line with the plurality of pulsating pockets of liquid and gas such that the product line is cleaned.

14. A method of cleaning a product line of a fluid dispensing system steps comprising:

providing a dispensing system having a product line extending from a first end to a second end that fluidly connects at least one container to a dispensing station;

detaching the product line from the at least one container and the dispensing station;

providing a cleaning system having a first container containing a liquid and a second container containing a gas;

providing a liquid supply line that connects with the first end of the product line to provide a fluid connection between the first and second containers and the product line;

pumping liquid through the liquid supply line;

introducing the gas from the second container into liquid within the liquid supply line such that a plurality of pockets of gas are formed; and eliminating a liquid boundary layer of the product line with the plurality of pockets of gas by pushing the liquid to engages opposite interior walls of the product line such that the liquid engages an interior boundary of the product line with mechanical cleaning action.

15. The method of claim 1 wherein the step of cleaning involves the pulsating pockets of gas pushing the liquid to engage opposite interior walls of the product line at a uniform rate.

16. The method of claim 13 wherein the step applying wall shear involves pushing the liquid to engage opposite interior walls of the product line at a uniform rate.

17. The method of claim 14 wherein the step of eliminating the liquid boundary layer of the product line involves pushing the liquid to engage opposite interior walls of the product line at a uniform rate.

18. The method of claim 1 further comprising the step of injecting the liquid having the plurality of gas pulsating pockets into the product line.

* * * * *